US009336929B2

(12) United States Patent
Holzmueller et al.

(10) Patent No.: US 9,336,929 B2
(45) Date of Patent: May 10, 2016

(54) ARTIFICIAL LIFT EQUIPMENT POWER CABLES

(71) Applicant: Schlumberger Technology Corporation, Sugar Land, TX (US)

(72) Inventors: Jason Holzmueller, Lawrence, KS (US); Patrick Zhiyuan Ma, Lawrence, KS (US); Gregory H. Manke, Overland Park, KS (US); Mark A. Metzger, Lawrence, KS (US); Melissa Ver Meer, Shawnee, KS (US); Sayak Datta, Lawrence, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 2 days.

(21) Appl. No.: 13/893,826

(22) Filed: May 14, 2013

(65) Prior Publication Data

US 2013/0306348 A1 Nov. 21, 2013

Related U.S. Application Data

(60) Provisional application No. 61/648,826, filed on May 18, 2012.

(51) Int. Cl.

| | |
|---|---|
| ***H01B 9/02*** | (2006.01) |
| ***H01B 7/04*** | (2006.01) |
| *E21B 43/12* | (2006.01) |

(52) U.S. Cl.

CPC ..... *H01B 9/02* (2013.01); *H01B 7/046* (2013.01); *E21B 43/128* (2013.01)

(58) Field of Classification Search

CPC ..... H01B 1/00; H01B 3/30; H01B 7/18; H01B 7/00; H01B 9/02; C08L 51/00; C08L 9/00; C08L 23/06; C08L 23/08; C08K 3/22; C08K 3/34; C08K 3/26; C08K 3/30; C08K 3/36

USPC ..... 174/102–108, 110, 113, 120, 121; 524/423, 430–433, 447, 504, 570, 571, 524/586

See application file for complete search history.

(56) References Cited

U.S. PATENT DOCUMENTS 3,429,984 A * 2/1969 Alexander ..... 174/115
3,943,271 A * 3/1976 Bahder et al. ..... 174/23 R (Continued)

FOREIGN PATENT DOCUMENTS

EP 880147 A1 11/1998

OTHER PUBLICATIONS

"Effect of Nanoscale Fillers on the Local Mechanical Behavior of Polymer Nanocomposites" by Ioannis Chasiotis dated Dec. 2009.*

(Continued)

*Primary Examiner* — Timothy Thompson
*Assistant Examiner* — Guillermo Egoavil
(74) *Attorney, Agent, or Firm* — Michael Stonebrook

(57) ABSTRACT

A power cable for artificial lift equipment can include one or more conductor assemblies, each including a copper conductor, a conductor shield with resistivity less than about 5000 ohm-m surrounding the conductor, insulation, an insulation shield having a resistivity less than about 5000 ohm-m surrounding the insulation, a metallic shield surrounding the insulation shield, and a polymer barrier surrounding the metallic shield. Such a cable may include a jacket molded about the one or more conductor assemblies and optionally armor surrounding the jacket. Various other apparatuses, systems, methods, etc., are also disclosed.

20 Claims, 9 Drawing Sheets

(56) References Cited

U.S. PATENT DOCUMENTS

| | | | | |
|---|---|---|---|---|
| 4,130,450 | A * | 12/1978 | Bahder et al. | 156/48 |
| 4,145,567 | A * | 3/1979 | Bahder et al. | 174/107 |
| 4,284,841 | A * | 8/1981 | Tijunelis et al. | 174/103 |
| 4,472,597 | A | 9/1984 | Uematsu et al. | |
| 4,703,134 | A * | 10/1987 | Uematsu | H01B 7/285 174/106 R |
| 5,279,147 | A * | 1/1994 | Bertini et al. | 73/40 |
| 6,127,632 | A * | 10/2000 | Oswald et al. | 174/120 R |
| 7,288,721 | B2 * | 10/2007 | Varkey et al. | 174/102 R |
| 2003/0111253 | A1 * | 6/2003 | Easter | 174/110 R |
| 2004/0217329 | A1 | 11/2004 | Easter | |
| 2006/0102376 | A1 * | 5/2006 | Kuchita et al. | 174/102 SC |
| 2006/0182961 | A1 * | 8/2006 | Person | B82Y 30/00 428/364 |
| 2008/0149363 | A1 | 6/2008 | Han et al. | |
| 2010/0036035 | A1 * | 2/2010 | Nelson et al. | 524/433 |
| 2010/0123356 | A1 * | 5/2010 | Sihler et al. | 307/105 |
| 2010/0163271 | A1 * | 7/2010 | Holzmueller et al. | 174/110 R |
| 2010/0186990 | A1 | 7/2010 | Neuroth et al. | |
| 2011/0171370 | A1 | 7/2011 | Holzmueller et al. | |
| 2011/0209895 | A1 | 9/2011 | Saito et al. | |
| 2011/0215278 | A1 | 9/2011 | Easter | |
| 2011/0240312 | A1 * | 10/2011 | Varkey et al. | 166/377 |
| 2011/0297391 | A1 | 12/2011 | Fielder et al. | |

OTHER PUBLICATIONS

International search report for the equivalent PCT patent application No. PCT/US2013/041488 issued on Aug. 27, 2013.

European Search Report issued in Application No. 13791590.6 on Mar. 30, 2015, 4 pages.

* cited by examiner

ARTIFICIAL LIFT EQUIPMENT POWER CABLES

RELATED APPLICATIONS

This application claims the benefit of and priority to U.S. Provisional Application Ser. No. 61/648,826, filed 18 May 2012, which is incorporated by reference herein.

BACKGROUND

Artificial lift equipment such as electric submersible pumps (ESPs) may be deployed for any of a variety of pumping purposes. For example, where a substance does not readily flow responsive to existing natural forces, an ESP may be implemented to artificially lift the substance. To receive power, an ESP is connected to a cable or cables. In some instances, the length of such a cable or cables may be of the order of several kilometers. A cable may also include one or more motor lead extensions (MLEs) spliced onto the cable. For example, where the cable includes three conductor cores for powering a motor, a MLE may be spliced onto each of the conductor cores. Length of a MLE may be, for example, on the order of tens of meters or more (e.g., about 20 meters to about 100 meters).

Some examples of available ESP cables include those rated at about 3 kV, about 4 kV or about 5 kV. For commercially available ESP cables, about 5 kV may be considered a present day upper rating limit for high temperature downhole cables (e.g., due to a lack of electrical stress relief layers, etc.).

As may be appreciated, ESP configurations, operations, etc. can depend on cable rating or integrity. As an example, reliability data for an ESP cable may be primary in estimating a mean time between failure (MTBF) for an operation. Failure of a cable can increase non-productive time (NPT), repair and replacement costs, etc., especially for deep installations (e.g., where over a kilometer of cable may be deployed).

Various technologies, techniques, etc., described herein pertain to cables, for example, to provide power to electrically powered equipment positionable in a well.

SUMMARY

A power cable for artificial lift equipment can include one or more conductor assemblies where each conductor assembly includes a copper conductor, a conductor shield with resistivity less than about 5000 ohm-m surrounding the conductor, insulation, an insulation shield having a resistivity less than about 5000 ohm-m surrounding the insulation, a metallic shield surrounding the insulation shield, and a polymer barrier surrounding the metallic shield; a jacket molded about the one or more conductor assemblies; and armor surrounding the jacket. A power cable for downhole equipment can include a copper conductor; a conductor shield with resistivity less than about 5000 ohm-m surrounding the conductor; insulation; an insulation shield having a resistivity less than about 5000 ohm-m surrounding the insulation; a metallic shield surrounding the insulation shield; a polymer barrier surrounding the metallic shield; a braided layer surrounding the metallic shield; and armor surrounding the braided layer. A method can include providing a conductor; providing a semiconductive material; providing an insulating material; extruding a portion of the semiconductive material onto the conductor; extruding the insulating material onto the semiconductive material; and extruding another portion of the semiconductive material onto the insulating material.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
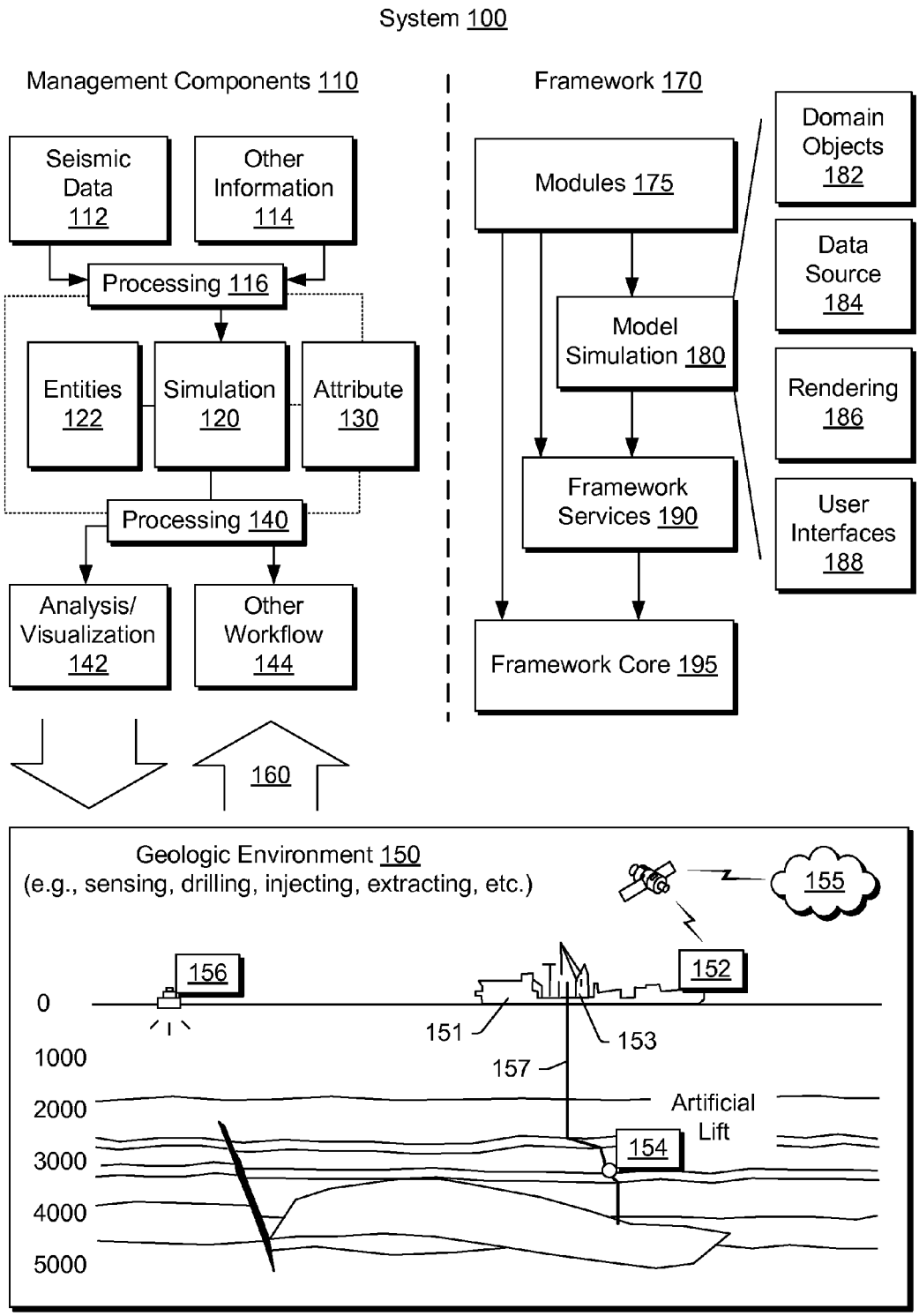
FIG. 1 illustrates an example of a system that includes various components for simulating and optionally interacting with a geological environment.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Artificial lift equipment such as electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that require, for example, pump rates in excess of about 4,000 barrels per day and lift of about 12,000 feet or more.

ESPs have associated costs, including equipment costs, replacement costs, repair costs, and power consumption costs. Selection of appropriate ESP specifications can be an arduous task, especially given the fact that many factors are dynamic and even stochastic. For example, composition of a pumped substance may vary over time, cost of electrical power may vary over time, entrainment of solids may vary over time, etc. The ability to predict variations in such factors with respect to time may span a spectrum from poor to excellent (e.g., depending on available data, models, etc.). Further, adjusting operation of an ESP for a change in one factor may give rise to unintended consequences. For example, a change in cost of power may give rise to a need to operate a pump motor with greater efficiency, which, in turn, may alter inlet pressure to the pump, which, in turn, may cause a change in phase composition of a substance being pumped, which, in turn, may impact the ability of centrifugal pump stages to lift the substance. Where a change in phase includes an increase in free gas (e.g., approaching 10% by volume), a condition known as gas lock may occur, a form of cavitation that can cause a pump to surge and fail prematurely.

To assist with selection of ESP specifications, a manufacturer may provide a plot with a pump performance curve that defines an optimal operating range for a given pump speed and fluid viscosity. Such a plot may include a head-capacity curve that shows amount of lift per pump stage at a given flow rate, a horsepower requirements curve across a range of flow capacities, and a pump efficiency curve, for example, calculated from head, flow capacity, fluid specific gravity and horsepower. As an example, an ESP may be specified as having a best efficiency point (BEP) of about 77% for a flow of about 7,900 barrels per day, a head of about 49 feet and a horsepower of about 3.69 for a fluid specific gravity of approximately 1.0 (e.g., REDA 538 Series, 1 stage at 3,500 RPM at 60 Hz). An ESP may be specified with a lift per stage such that a number of stages may be selected for an application to meet lift requirements.

Adjustments may be made to an ESP, for example, where the ESP is outfitted with a variable-speed drive (VSD) unit. A VSD unit can include an ESP controller such as, for example, the UniConn™ controller marketed by Schlumberger Limited (Houston, Tex.). In combination, a VSD unit with an ESP controller allows for variations in motor speed to pump optimal rates at variable frequencies, which can better manage power, heat, etc. As to heat generated by a motor, an ESP may rely on flow of pumped fluid for cooling such that a change in motor speed can change steady-state operating temperature of the motor and, correspondingly, efficiency of the motor. Given such relationships, trade-offs can exist, for example, between motor lifetime, power consumption and flow rate.

To improve ESP operations, an ESP may include one or more sensors (e.g., gauges) that measure any of a variety of phenomena (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current-leakage. An ESP monitoring system may include a supervisory control and data acquisition system (SCADA). Commercially available surveillance systems include the espWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop or control ESP speed via an ESP controller.

As an example, a commercially available surface-use cable rated for voltages higher than about 5 kV may be round and based on NEMA WC 71/ICEA S-96-659 and WC 74/ICEAS-93-639. Such a cable may include the following: a copper conductor, a semiconductive conductor shield layer, an insulation layer, semiconductive insulation shield layer, conductive metallic shield layer (e.g., metallic braid or tape wrap, with copper), a cable jacket (polyethylene), and armor (galvanized steel). However, in comparison to surface environments, downhole environments may be harsh in terms of temperature, pressure and chemistry. Further, downhole environments may be harsh mechanically. For example, consider abrasion and mechanical stresses that may occur as a cable traverses hundreds of meters, especially where the cable carries the weight of equipment such as an ESP. Yet further, a downhole installation that may have a length of a kilometer or more may offer little opportunity for filtering, etc. to handle electrical issues such as voltage spikes (e.g., due to resonance, etc.). Additionally, information about downhole equipment may be limited in comparison to a surface operation. For example, where a surface mounted motor may be readily fitted with sensors, etc., and associated data transmission lines, a data transmission line for a downhole motor may be so long that data bandwidth and data integrity become problematic. Lack of information about operating conditions of a downhole motor may increase risk of issues that could detrimentally impact cable performance and reliability. Accordingly, downhole operations present factors not present in surface operations (e.g., or not present to the same extent as in surface operations).

As to power cables suitable for downhole operations, as an example, a round ESP cable rated for operation up to about 5 kV can include one or more copper conductors, oil and heat resistant EPDM rubber insulation (e.g., where The E refers to ethylene, P to propylene, D to diene and M refers to a classification in ASTM standard D-1418; e.g., ethylene copolymerized with propylene and a diene), a barrier layer (e.g., lead/fluoropolymer or none for low cost cables), a jacket (e.g., oil resistant EPDM or nitrile rubber), and armor (e.g., galvanized or stainless steel or MONEL® alloy marketed by Inco Alloys International, Inc., Huntington, W. Va.). As another example, a flat ESP cable for operation up to about 5 kV can include one or more copper conductors, oil and heat resistant EPDM rubber insulation, barrier layer (e.g., lead/fluoropolymer or none for low cost cables), a jacket layer (oil resistant EPDM or nitrile rubber or none for low cost cables), and armor (galvanized or stainless steel or MONEL® alloy marketed by Inco Alloys International, Inc., Huntington, W. Va.).

As an example, an insulation material for a cable may be EPDM. EPDM compounds tend to have good dielectric properties and heat resistance, but tend to be susceptible to swelling when exposed to hydrocarbons. In downhole oilfield applications, permeation of outer layers of a cable by fluid may result in fluid contacting the insulation. To mitigate such risks, ESP cable manufacturers may use proprietary EPDM compound formulations designed to limit the effects of hydrocarbons. Such formulations may be referred to as low-swell EPDM or oil resistant EPDM.

As to particular gas risks, as an example, consider a downhole environment at elevated pressures (e.g., greater than about 1,000 psi), which may cause gas intrusion into an ESP, an ESP cable, etc. In such an example, where hydrogen sulfide ($H_2S$) gas is present at elevated pressure, it may permeate through elastomers and corrode copper conductors of insufficiently robust cables. Further, once downhole gases have permeated a cable, a rapid change in well pressure can cause explosive decompression damage, rendering a cable inoperable.

Elastomer compounds that may be found in commercially available ESP cable jacketing (e.g., EPDM and/or nitrile) tend to be proprietary oilfield formulations. EPDM based jacketing materials, as with EPDM insulation materials, tend to be formulated for oil and decompression resistance. Nitrile compounds have inherent oil resistance, however, as an example, some oilfield specific nitrile compounds aim to combine oil resistance with brine and water resistance as well as decompression resistance and good heat aging.

As an example of a commercially available power cables suitable for downhole use, consider the the RedaMAX™ Hotline™ ESP power cables (e.g., as well as motor lead extensions "MLEs"), which are marketed by Schlumberger Limited (Houston, Tex.). As an example, a RedaMAX™ Hotline™ ESP power cable can include combinations of polyimide tape, lead, EPDM, and polyether ether ketone (PEEK, e.g., or another poly aryl ether ketone (PAEK) type of polymer) to provide insulation and a jacket. Lead walls can provide for compatibility with high gas/oil ratio (GOR) and highly corrosive conditions. Armor can mechanically protect the cable and may be galvanized steel, heavy galvanized steel, stainless steel, or MONEL® alloy. As an example, a pothead, an electrical connector between a cable and an ESP motor, may be constructed with metal-to-metal seals or elastomer seals. A pothead can provide a mechanical barrier to fluid entry in high-temperature applications.

The RedaMAX™ Hotline™ ESP power cables may be suitable for use in wells with high bottomhole temperatures, steamflooding and thermal recovery applications, geothermal applications, gassy wells, wells with corrosive fluids, including $H_2S$, $CO_2$, and chemical treatments.

As an example of a RedaMAX™ Hotline™ ESP power cable, a 5 kV round ELBE G5R can include solid conductor sizes of about #1 AWG (e.g., 1 AWG/1), about #2 AWG (e.g., 2 AWG/1) and about #4 AWG (e.g., 4 AWG/1). As to conversion to metric, #1, #2 and #4 AWG correspond to approximately 42.4 $mm^2$, 33.6 $mm^2$, and 21.1 $mm^2$, respectively. As another example, a 5 kV flat EHLTB G5F can include a solid conductor size of #4 AWG (e.g., 4 AWG/1). As an example, dimensions may be, for round configurations, about 1 to 2 inches in diameter and, for flat configurations, about half an inch by about 1 inch to about 2 inches. As an example, weights may range from about 1 lbm/ft to about 3 lbm/ft.

Various examples of power cables and various examples of method for making a power cable (e.g., or a portion thereof) are described herein. Such power cables can include at least one layer formed of a semiconductive material. For example, a cable may include a semiconductive conductor shield and a semiconductive insulation shield. In such an example, semiconductive material may be fed via an extruder or extruders for deposition onto another layer (e.g., a conductor and an insulation layer, respectively). As an example, insulation or an insulation layer may be deposited via extrusion onto a conductor shield via an extrusion process, optionally a co-extrusion process that deposits both the conductor shield and the insulation (e.g., which may allow for cross-linking at an interface therebetween). As an example, an insulation shield may be deposited onto insulation in a manner that facilitates stripping of the insulation shield from the insulation, for example, for purposes of splicing a conductor about which the insulation is deposited (e.g., with an intermediate conductor shield).

As an example, a cable suitable for downhole use may be constructed with materials having properties resistant to conditions associated with a corrosive oilfield environment, resistant to hydrocarbons, resistant to high pressure gases, and/or capable of operating at temperatures above about 180 degrees C.

As an example, a power cable may include multiple conductors where each conductor has an associated conductor shield, insulation, insulation shield, metallic shield, and barrier layer. For each conductor, such a layered assembly may be referred to as a single conductor cable. For a power cable that includes multiple conductors, configured as multiple single conductor cables, a cable jacket may be provided that jackets the multiple single conductor cables. Further, one or more armor layers may surround the cable jacket.

As an example, a motor lead extension (MLE) may be a single conductor cable. Such a single conductor cable may include a conductor, a conductor shield, insulation, an insulation shield, a metallic shield, a barrier layer, a braid layer, and armor. Where a conductor has a cylindrical shape, the various components may be annular in shape of increasing diameter where thickness of each annular component is selected, for example, according to function to provide suitable physical characteristics for purposes of withstanding operational conditions, including electromagnetic and environmental conditions. Such an arrangement of components may be coaxial, for example, various components may be arranged coaxially about a conductor, which may be a solid conductor, a braided conductor, etc.

As an example, (e.g., to lower cost, ease spooling, etc.) MLEs may be consolidated into an N-across flat cable (e.g., where N equals a number of conductors). In such an example, each conductor may have an individual armor jacket where an overall additional armor layer helps to tie the individual armor jacketed conductors together. As an alternative example, consolidated MLEs may include an overall armor layer (e.g., or jacket). In the foregoing MLE examples, an outer jacket may be individual, consolidated, or skipped entirely.

As to conductors, for example, a cable may include conductors of high purity copper, which may be solid, stranded or compacted stranded. Stranded and compacted stranded conductors can offer improved flexibility, which may be an advantage in some installations. Conductors may also be coated with a corrosion resistant coating to prevent conductor degradation from the hydrogen sulfide gas which is commonly present in downhole environments. Examples of such a coating would include tin, lead, nickel, silver, or other corrosion resistant alloy or metal.

As to conductors, compacted strands provide a combination of flexibility and reduced cross section. A coating may be applied to a conductor, for example, to prevent/slow corrosion of copper by downhole gases. Such a coating may be compatible with a subsequent process (e.g., conductor shield extrusion, etc.). As an example, a corrosion resistant coating may be provided in an effort to prevent conductor degradation from $H_2S$ gas. Such a coating may include, for example, tin, lead, nickel, silver, or another corrosion resistant alloy or metal.

As an example, a gas-blocking coating may be applied to a conductor, for example, an Amalloy™ lead-based metal alloy may be applied to one or more conductors (e.g., to help block gas such as gas that includes $H_2S$).

As to conductor shields, a conductor shield may be a semiconductive layer around the conductor (e.g., optionally including a coating) that acts to control electrical stress in a cable to minimize discharge. Such a layer may include a thickness of about 0.002" to about 0.020". Such a layer may be bonded to the conductor (e.g., optionally including a coating) and insulation to prevent gas migration or it may be strippable to allow for easy cable repair, splicing, etc. As an example, a strippable conductor shield can assist with easy cable repair and splicing. Whether or not a conductor shield is bonded may depend on the application.

As an example, a conductor shield may be a semiconductive tape wrap or an extruded semiconductive polymer composition. Such a layer may be an elastomer or thermoplastic co-extruded with insulation. As an example, co-extruded elastomer insulation shield and insulation may allow for cross-linking the insulation shield and insulation materials. Co-extruded thermoplastics may provide for intimate bonding (e.g., optionally without cross-linking). Such manufacturing processes can help eliminate voids at the conductor shield/insulation interface.

As mentioned, material used for the conductor shield may be semiconductive, for example, defined as having a resistivity less than about 5000 ohm-m. As an example, an elastomer (e.g., EPDM) compound loaded with conductive fillers may be used. As an example, for high temperature and reliability improvement, a PEEK compound (or related high temperature polymer) containing conductive or semiconductive fillers may be used. Selection of the optimum filler type and filler quantity can help achieve an optimum level of volume resistivity in the compound. The insulation shield and the insulation may include the same or similar material, which can facilitate processing.

As to a conductor shield, it may have some adhesion to a conductor to provide a void-free interface. Adhesion to a conductor can also help prevent downhole gases from migrating along a cable. Extrusion can provide a relatively smooth surface (e.g., compared to tape) and tend to allow for penetration of material into spaces between strands of a conductor. Noting that, for a conductor shield, irregularities in its surface may cause voltage stress points. A conductor shield may be an elastomer or thermoplastic co-extruded or tandem extruded with insulation allowing the layers to cross-link together (e.g., elastomer) or intimately "bond" (e.g., thermoplastic), which may help to eliminate voids at the interface of these layers. Such an approach can provide for discharge resistance (e.g., for EPDM and PAEK insulation materials). A conductor shield may include several different elastomers. A conductor shield may include nanoscale fillers (e.g., to provide a combination of low resistivity and good mechanical properties).

As to insulation, it may include a material such as, for example, EPDM or, for example, for improved temperature and reliability, PEEK may be used (e.g., or another PAEK material). For EPDM-based insulation, a compound formulation for oil and decompression resistance may be selected. As to PEEK, it may provide improved mechanical properties that allow for improved damage resistance during cable installation and cable operation. The higher stiffness of PEEK may also allow for greater ease in sealing over cable members at cable termination points (motor pothead, well connectors, feed-throughs, etc.). Such construction can improve reliability of the cable and of a system.

Insulation (e.g., an insulation layer) may adhere to or be bonded to a conductor shield. Insulation may be continuous with an insulation shield, optionally completely or partially bonded. As an example, a continuous defect-free interface may be formed between insulation and a conductor shield (e.g., with some amount of adhesion). Cable connections may, at times, be considered weak points of a system. As an example, PEEK insulation can improve seal reliability at high temperature and improve sealing through thermal cycling (high operating temp followed by shutdown and large temperature drops).

As to an insulation shield, it may include a material that is semiconductive, for example, applied as a layer over insulation to minimize electrical stresses in a cable. An insulation shield may be bonded to insulation or it may be readily strippable. Some adhesion between layers of a cable may help to prevent voids or defects in a cable. An insulation shield material may be a semiconductive tape or a semiconductive polymer composite. As an example, a conductor shield and an insulation shield may optionally be co-extruded with insulation to help ensure more complete contact between surfaces. As to semiconductivity, an insulation shield material may be defined as having a resistivity less than about 5000 ohm-m. As an example, the same material may be used for an insulation shield as for a conductor shield. As another example, a different material may be used (e.g., to enhance strip-ability, processing, etc.).

As an example, an insulation shield and/or a conductor shield may be made of a semiconductive EPDM material such as described in US Patent Application Publication No. 2011/0171370, which is incorporated by reference herein. As an example, an insulation shield and/or a conductor shield may include carbon black powder(s), carbon nanontubes, etc. to increase conductivity of a polymer matrix to form a semiconductive polymer composite material.

As to an insulation shield, it may be well adhered but, for example, be removable (e.g., for splicing) where, after removal there is minimal or no residual material left on the insulation. Extruded polymer can provide for a smooth surface. As to smooth surfaces, such surfaces may provide for reduction in stress (e.g., on surrounding layers, during bending, etc.).

As to a metallic shield, outside of an insulation shield, a metallic shield layer can optionally be applied to serve as a ground plane. Such a layer can serve to electrically isolate the various phases of the conductors of the cable from each other. For example, copper, aluminum, lead, or other conductive material tape, braid, paint, or extrusion may be applied to provide a conductive layer. Such a layer may also serve as a barrier to downhole gas and fluids, protecting the inner cable layers. For example, a metallic shield may be lead (Pb), as lead tends to be inert and resistant to downhole fluids and gases. Lead layers may also provide an impermeable gas barrier. Lead (Pb) materials used in barriers may include lead (Pb) alloyed with small amounts of additives to enhance properties (e.g., copper bearing or antimonial lead); noting that high purity lead (Pb) may be used.

As to a barrier layer, such a layer may help protect a cable from corrosive downhole gases and fluids, noting that additional barrier layers may then be applied if desired. A barrier may be provided as an extruded or taped layer(s) of fluoropolymers, lead, or other material (e.g., to help protect against well fluids). As an example, a combination of extruded and taped layers may be used. As to a barrier layer, as an example, helically taped PTFE fluoropolymer tape may be used.

As to a cable jacket, for round cable designs (e.g., where three conductors may be twisted together), a fluid, gas and temperature resistant jacket may be used. This jacket can help protect a cable from damage in extreme downhole environments. Such a cable jacket may include one or more layers of EPDM, nitrile, HNBR, fluoropolymer, chloroprene, or other material (e.g., resistant to a downhole environment). As an example, cable phases may be split out from each other with each phase encased in solid metallic tubing.

As to a cable jacket, as an example, a round cable (e.g., circular cross-section) can provides for damage resistance and balanced temperature distribution and electrical fields. As another example, conductors assemblies may be set in a side by side arrangement as a "flat" cable (e.g., polygonal or rectangular cross-section) for applications with space constraints downhole. As an example, cable phases may be split out from each other with each phase encased in solid metallic tubing (e.g., optionally without an overall jacket). Such a conductor arrangement may provide for motor lead extensions where splitting out the phases makes them easier to terminate and provides improved cooling from the ambient.

As to cable armor, cable armor may be, for example, galvanized steel, stainless steel, MONEL® alloy, or other metal, metal alloy, or non-metal (e.g., resistant to downhole conditions). Multiple layers of armor may be included or applied for improved damage resistance. Armor may be a helically spun metal, alloy or other material.

As an example, a power cable (e.g., and optionally one or more lead extensions) may be employed to power a higher voltage "high horsepower" type of ESP systems. Such ESP systems find use in subsea applications where high reliability is quite desirable (e.g., long MTBF, etc.). As an example, a power cable (e.g., and optionally one or more lead extensions), may be employed in an industry for power transmission in high temperature/corrosive applications.

As an example, a higher voltage rated cable may be used to power a "high horsepower" system. As an example, a higher voltage rated cable may be used to improved run-time of a system (e.g., initially ran at lower voltage such as about 5 kV and below). As an example, if one phase (e.g., one phase line or phase conductor) of a 3-phase power system fails, it may be possible to increase voltage on the other two phases (e.g., other two phase lines or phase conductors), for example, such that an ESP system can continue to operate (e.g., without costly physical intervention). In such an example, higher voltage rated cables may provide for some additional assurances at the higher voltages on the other two phases. For example, insulating capabilities may help to assure breakdown (e.g., current leakage) does not occur at the higher voltages of the two phases.

As an example, use of a cable rated at a voltage higher than about 5 kV (e.g., about 8 kV) in an about 5 kV system may allow for increased reliability. For example, if one of the cable phases (e.g., phase lines or phase conductors) is damaged or fails, voltage may be increased beyond about 5 kV on the remaining two phases to provide for continued operation of the system. Such an approach may be especially valuable in deepwater applications where physical intervention is cost prohibitive.

As an example, a cable may include one or more conductive ground planes, for example, to handle failure of a phase (e.g., a phase line or phase conductor) to ground (e.g., without damaging the other phases or the cable armor or jacket).

As an example, a higher voltage rated cable may allow for handling voltage drops associated with cable length (e.g., to account for voltage drop in very long cables, which may be particularly useful in deepwater subsea applications).

To understand better how artificial lift equipment power cables may fit into an overall strategy, some examples of processes are described below as applied to basins and, for example, production from one or more reservoirs in a basin.

FIG. 1 shows an example of a system 100 that includes various management components 110 to manage various aspects of a geologic environment 150 such as a basin that may include one or more reservoirs. For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the geologic environment 150 may be outfitted with any of a variety of sensors, detectors, actuators, ESPs, etc. For example, equipment 152 may include communication circuitry to receive and to transmit information with respect to one or more networks 155. Such information may include information associated with downhole equipment 154 (e.g., an ESP), which may include equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc.

In the example of FIG. 1, the downhole equipment 154 may be artificial lift equipment that is powered by a power cable, which may optionally also provide for data transmission (e.g., uni- or bi-directional). In FIG. 1, a line labeled 157 may be a power cable, a power cable and piping, etc. As shown, a power cable may be exposed to water, which may be high in salts and corrosive. As shown, a cable may be partially in water and partially in a wellbore. Accordingly, a cable may be exposed to various, different types of environments. Such environments may pose different constraints germane to cable integrity.

As to the management components 110 of FIG. 1, these may include a seismic data component 112, an information component 114, a pre-simulation processing component 116, a simulation component 120, an attribute component 130, a post-simulation processing component 140, an analysis/visualization component 142 and a workflow component 144. In operation, seismic data and other information provided per the components 112 and 114 may be input to the simulation component 120, optionally with pre-simulation processing via the processing component 116 and optionally with post-simulation processing via the processing component 140.

According to an embodiment, the simulation component 120 may rely on entities 122. Entities 122 may be earth entities or geological objects such as wells, surfaces, reservoirs, etc. In the system 100, the entities 122 may include virtual representations of actual physical entities that are reconstructed for purposes of simulation. The entities 122 may be based on data acquired via sensing, observation, etc. (e.g., the seismic data 112 and other information 114).

According to an embodiment, the simulation component 120 may rely on a software framework such as an object-based framework. In such a framework, entities may be based on pre-defined classes to facilitate modeling and simulation. A commercially available example of an object-based framework is the MICROSOFT™.NET™ framework (Redmond, Wash.), which provides a set of extensible object classes. In the .NET™ framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may be a library of attributes. Such processing may occur prior to input to the simulation component 120. Alternatively, or in addition to, the simulation component 120 may perform operations on input information based on one or more attributes specified by the attribute component 130. According to an embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results. Additionally, or alternatively, output from the simulation component 120 may be input to one or more other workflows, as indicated by a workflow component 144. Further, dotted lines indicate possible feedback within the management components 110. For example, feedback may occur between the analysis/visualization component 142 and either one of the processing components 116 and 140.

According to an embodiment, the management components 110 may include features of a commercially available simulation framework such as the PETREL™ seismic to simulation software framework (Schlumberger Limited, Houston, Tex.). The PETREL™ framework provides components that allow for optimization of exploration and development operations. The PETREL™ framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of simulating a geologic environment).

According to an embodiment, the management components 110 may include features for geology and geological modeling to generate high-resolution geological models of reservoir structure and stratigraphy (e.g., classification and estimation, facies modeling, well correlation, surface imaging, structural and fault analysis, well path design, data analysis, fracture modeling, workflow editing, uncertainty and optimization modeling, petrophysical modeling, etc.). As to reservoir engineering, for a generated model, one or more features may allow for simulation workflow to perform streamline simulation, reduce uncertainty and assist in future well planning (e.g., uncertainty analysis and optimization workflow, well path design, advanced gridding and upscaling, history match analysis, etc.). The management components 110 may include features for drilling workflows including well path design, drilling visualization, and real-time model updates (e.g., via real-time data links).

According to an embodiment, various aspects of the management components 110 may be add-ons or plug-ins that operate according to specifications of a framework environment. For example, a commercially available framework environment marketed as the OCEAN™ framework environment (Schlumberger Limited, Houston, Tex.) allows for seamless integration of add-ons (or plug-ins) into a PETREL™ framework workflow. The OCEAN™ framework environment leverages .NET™ tools (Microsoft Corporation, Redmond, Wash.) and offers stable, user-friendly interfaces for efficient development. According to an embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may be the commercially available OCEAN™ framework where the model simulation layer 180 is the commercially available PETREL™ model-centric software package that hosts OCEAN™ framework applications. According to an embodiment, the PETREL™ software may be considered a data-driven application.

The model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

In the example of FIG. 1, the domain objects 182 can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

The PETREL™ framework can integrate multidisciplinary workflows surrounding ECLIPSE™ simulation modules, for example, to provide transparent data flows and an intuitive graphical user interface. Modules may include the ECLIPSE™ blackoil simulation module for three-phase, 3D reservoir simulation with extensive well controls, field operations planning, and comprehensive enhanced oil recovery (EOR) schemes; the ECLIPSE™ compositional simulation module for reservoir fluid phase behavior and compositional changes, when modeling multicomponent hydrocarbon flow; the ECLIPSE™ FrontSim™ simulation module for modeling multiphase fluid flow along streamlines, supporting both geological model screening and pattern flood management; the ECLIPSE™ thermal simulation module for support of a wide range of thermal recovery processes, including steam-assisted gravity drainage, cyclic steam operations, toe-to-heel air injection, and cold heavy oil production with sand; and one or more other modules such as a coalbed methane module, an advanced well module, etc. As described herein, an ESP controller may optionally provide for access to one or more frameworks (e.g., PETREL™, ECLIPSE™, PIPESIM™, etc.).

In the example of FIG. 1, as indicated, the management components 110 may receive information (see, e.g., the feedback 160) from the geologic environment 150. As an example, the downhole equipment 154 may include an ESP outfitted with one or more sensors that transmit data as, for example, the other information 114. In turn, one or more of the management components 110 may process the data to provide instructions to the geologic environment 150, for example, to adjust one or more operational parameters that may impact operation of the downhole equipment 154 (e.g., an ESP). As shown in FIG. 1, transmission of information may occur via one or more networks. Further, information from other geologic environments, other downhole equipment, etc., may be transmitted to one or more of the management components 110.

Figure 2:
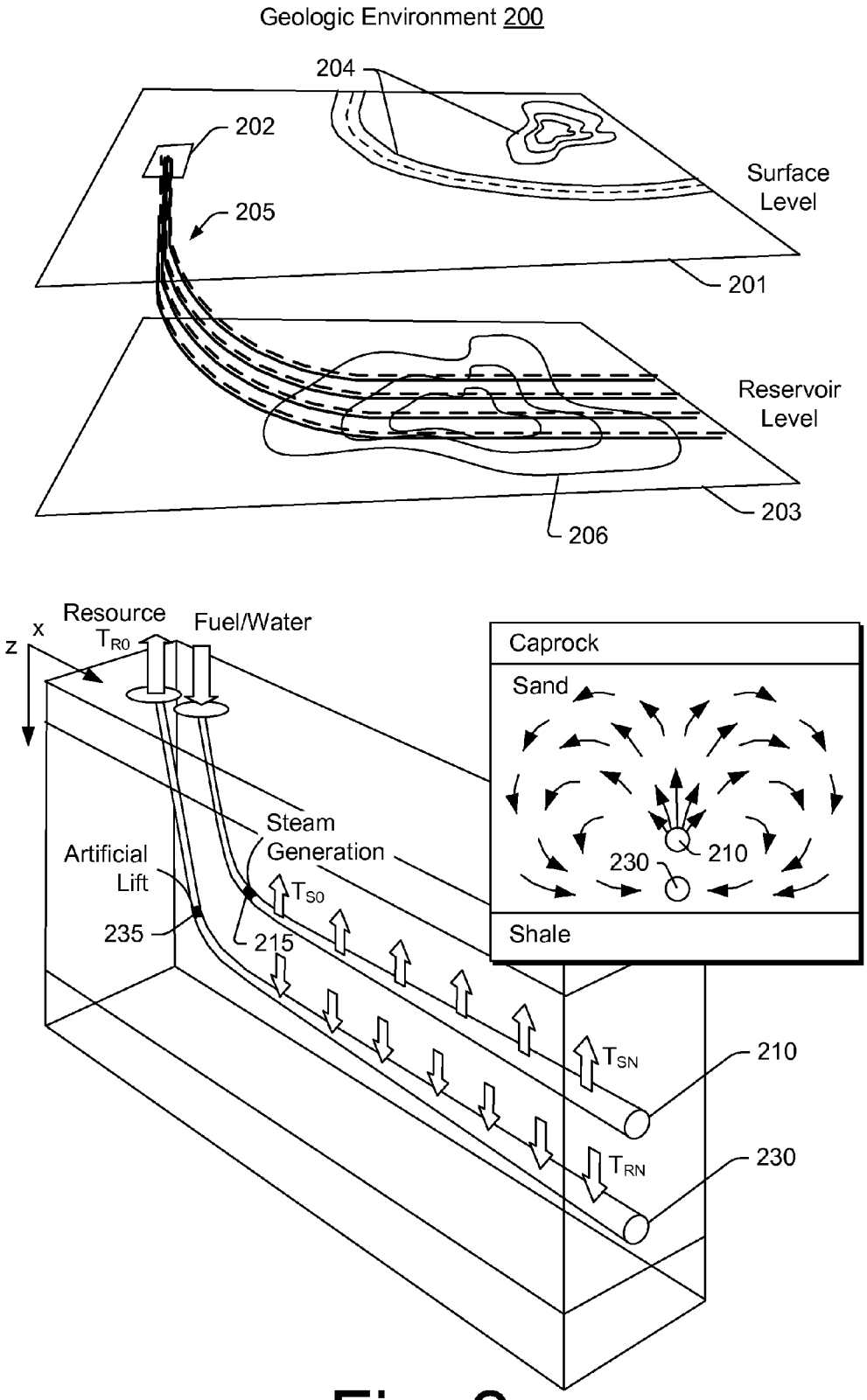
FIG. 2 illustrates an example of geologic environment that includes steam injection and artificial lift.

FIG. 2 shows an example of a geologic environment 200 (e.g., a basin) being defined, for example, as including a surface level 201 (e.g., upper surface or layer) and a reservoir level 203 (e.g., lower surface or layer). As shown in FIG. 2, a structure 202 may be placed (e.g., built) on the surface level 201 for drilling or operating subsurface equipment 205 for exploring, injecting, extracting, etc. Further, placement of the structure 202 may, for example, account for various constraints such as roads, soil conditions, etc. As shown, the structure 202 may be, for example, a pad for a rig or rigs (e.g., to drill, to place equipment, to operate equipment, etc.).

In the example of FIG. 2, the equipment 205 may be steam assisted gravity drainage (SAGD) equipment for injecting steam and extracting resources from a reservoir 206. For example, a SAGD operation can include a steam-injection well 210 and a resource production well 230. SAGD equipment may be considered artificial lift equipment as it can assist with artificial lift. As an example, a power cable may be connected to SAGD equipment. Further, where such equipment includes a motor or other electrically powered unit (e.g., a heating unit), one or more MLEs may be provided, which may be referred to as "lead extensions" (e.g., where they do not power a motor).

In the example of FIG. 2, a downhole steam generator 215 generates steam in the injection well 210, for example, based on supplies of water and fuel from surface conduits, and artificial lift equipment 235 (e.g., ESP, etc.) may be implemented to facilitate resource production. While a downhole steam generator is shown, steam may be alternatively, or additionally, generated at the surface level. As illustrated in a cross-sectional view, the steam rises in the subterranean portion. As the steam rises, it transfers heat to a desirable resource such as heavy oil. As the resource is heated, its viscosity decreases, allowing it to flow more readily to the resource production well 230.

As illustrated in the example of FIG. 2, SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

With respect to extraction, SAGD may result in condensed steam from an upper well may accompany oil to a lower well, which can impact artificial lift (e.g., ESP) operations and increase demands on separation processing where it is desirable to separate one or more components from the oil and water mixture.

As to the downhole steam generator 215, it may be fed by three separate streams of natural gas, air and water where a gas-air mixture is combined first to create a flame and then the water is injected downstream to create steam. In such an example, the water can also serve to cool a burner wall or walls (e.g., by flowing in a passageway or passageways within a wall).

The example of FIG. 2 demonstrates how operation of a steam generator or, more generally, steam injection, may impact operation of downhole equipment such as an ESP. Referring to the example of FIG. 1, the management components 110 may receive information (see, e.g., the feedback 160) from the geologic environment 150; similarly, the management components 110 may apply to the geologic environment 200 of FIG. 2, for example, where the equipment 215, the equipment 235 or both may transmit data as, for example, the other information 114. In turn, one or more of the management components 110 may process the data to provide instructions to the environment 200, for example, to adjust one or more operational parameters that may impact operation of the equipment 215, the equipment 235 (e.g., an ESP), or other equipment. As shown in FIG. 1, transmission of information may occur via one or more networks. Further, information from other geologic environments, other downhole equipment, etc., may be transmitted to one or more of the management components 110.

Figure 3:
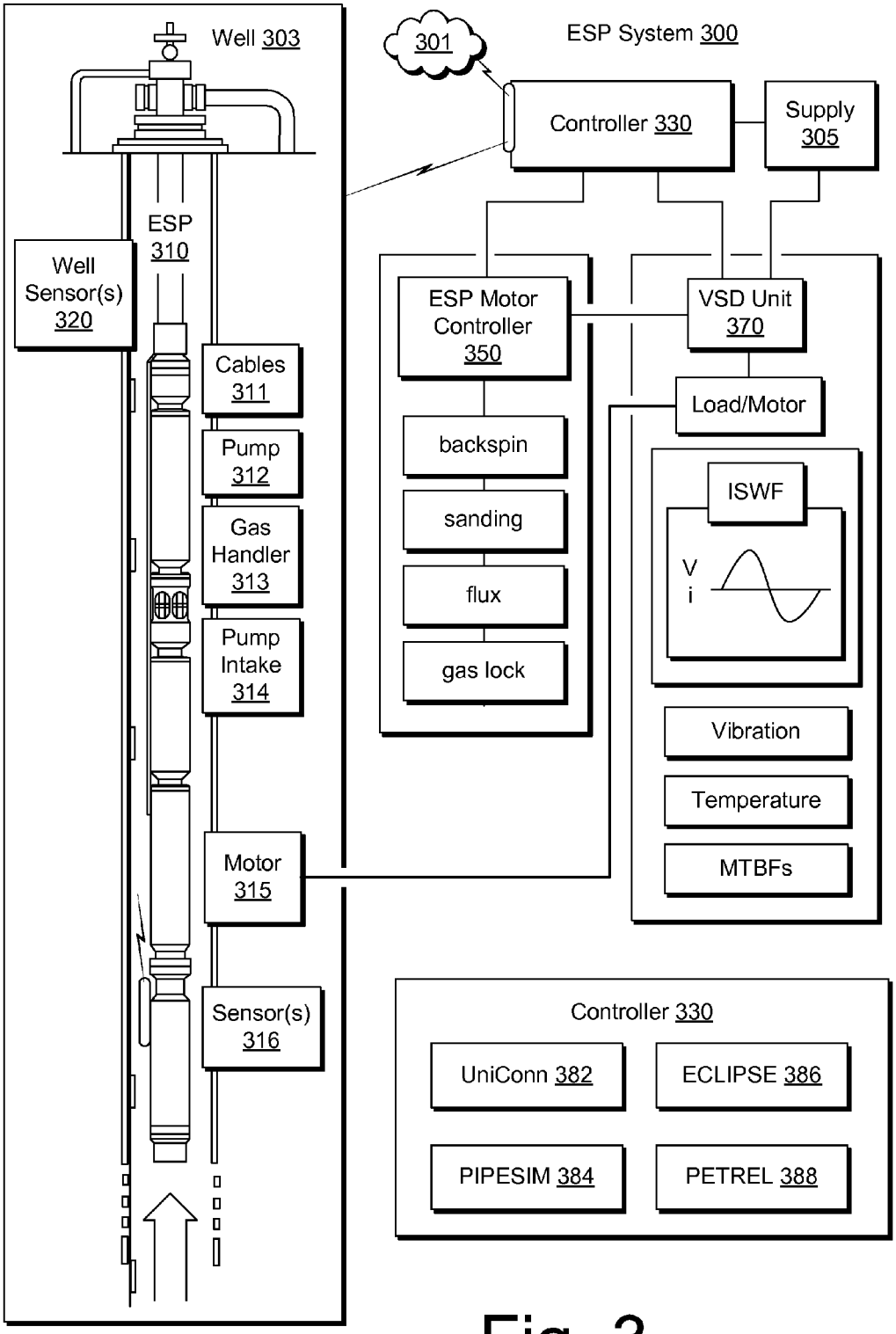
FIG. 3 illustrates an example of an electric submersible pump system.

FIG. 3 shows an example of an ESP system 300 as including a network 301, a well 303 disposed in a geologic environment, a power supply 305, an ESP 310, a controller 330, a motor controller 350 and a VSD unit 370. The power supply 305 may receive power from a power grid, an onsite generator (e.g., natural gas driven turbine), or other source. The power supply 305 may supply a voltage, for example, of about 4.16 kV.

The well 303 includes a wellhead that can include a choke (e.g., a choke valve). For example, the well 303 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

The ESP 310 includes cables 311, a pump 312, gas handling features 313, a pump intake 314, a motor 315 and one or more sensors 316 (e.g., temperature, pressure, current leakage, vibration, etc.). The well 303 may include one or more well sensors 320, for example, such as the commercially available OpticLine™ sensors or WellWatcher BriteBlue™ sensors marketed by Schlumberger Limited (Houston, Tex.). Such sensors are fiber-optic based and can provide for real time sensing of temperature, for example, in SAGD or other operations. As shown in the example of FIG. 2, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well (e.g., 4,000 feet or more) and beyond a position of an ESP.

The controller 330 can include one or more interfaces, for example, for receipt, transmission or receipt and transmission of information with the motor controller 350, a VSD unit 370, the power supply 305 (e.g., a gas fueled turbine generator, a power company, etc.), the network 301, equipment in the well 303, equipment in another well, etc.

As shown in FIG. 3, the controller 330 can include or provide access to one or more modules or frameworks. Further, the controller 330 may include features of an ESP motor controller and optionally supplant the ESP motor controller 350. For example, the controller 330 may include the UniConn™ motor controller 382 marketed by Schlumberger Limited (Houston, Tex.). In the example of FIG. 3, the controller 330 may access one or more of the PIPESIM™ framework 384, the ECLIPSE™ framework 386 and the PETREL™ framework 388.

In the example of FIG. 3, the motor controller 350 may be a commercially available motor controller such as the UniConn™ motor controller. The UniConn™ motor controller can connect to a SCADA system, the espWatcher™ surveillance system, etc. The UniConn™ motor controller can perform some control and data acquisition tasks for ESPs, surface pumps or other monitored wells. The UniConn™ motor controller can interface with the Phoenix™ monitoring system, for example, to access pressure, temperature and vibration data and various protection parameters as well as to provide direct current power to downhole sensors. The UniConn™ motor controller can interface with fixed speed drive (FSD) controllers or a VSD unit, for example, such as the VSD unit 370.

For FSD controllers, the UniConn™ motor controller can monitor ESP system three-phase currents, three-phase surface voltage, supply voltage and frequency, ESP spinning frequency and leg ground, power factor and motor load.

For VSD units, the UniConn™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

The UniConn™ motor controller can include control functionality for VSD units such as target speed, minimum and maximum speed and base speed (voltage divided by frequency); three jump frequencies and bandwidths; volts per hertz pattern and start-up boost; ability to start an ESP while the motor is spinning; acceleration and deceleration rates, including start to minimum speed and minimum to target speed to maintain constant pressure/load (e.g., from about 0.01 Hz/10,000 s to about 1 Hz/s); stop mode with PWM carrier frequency; base speed voltage selection; rocking start frequency, cycle and pattern control; stall protection with automatic speed reduction; changing motor rotation direction without stopping; speed force; speed follower mode; frequency control to maintain constant speed, pressure or load; current unbalance; voltage unbalance; overvoltage and undervoltage; ESP backspin; and leg-ground.

In the example of FIG. 3, the ESP motor controller 350 includes various modules to handle, for example, backspin of an ESP, sanding of an ESP, flux of an ESP and gas lock of an ESP. As mentioned, the motor controller 350 may include any of a variety of features, additionally, alternatively, etc.

In the example of FIG. 3, the VSD unit 370 may be a low voltage drive (VSD) unit, a medium voltage drive (MVD) unit or other type of unit. For a LVD, a VSD unit can include a step-up transformer, control circuitry and a step-up transformer while, for a MVD, a VSD unit can include an integrated transformer and control circuitry. As an example, the VSD unit 370 may receive power with a voltage of about 4.16 kV and control a motor as a load with a voltage from about 0 V to about 4.16 kV.

The VSD unit 370 may include commercially available control circuitry such as the SpeedStar™ MVD control circuitry marketed by Schlumberger Limited (Houston, Tex.). The SpeedStar™ MVD control circuitry is suitable for indoor or outdoor use and comes standard with a visible fused disconnect switch, precharge circuitry, and sine wave output filter (e.g., integral sine wave filter, ISWF) tailored for control and protection of high-horsepower ESPs. The SpeedStar™ MVD control circuitry can include a plug-and-play sine wave output filter, a multilevel PWM inverter output, a 0.95 power factor, programmable load reduction (e.g., soft-stall function), speed control circuitry to maintain constant load or pressure, rocking start (e.g., for stuck pumps resulting from scale, sand, etc.), a utility power receptacle, an acquisition system for the Phoenix™ monitoring system, a site communication box to support surveillance and control service, a speed control potentiometer. The SpeedStar™ MVD control circuitry can optionally interface with the UniConn™ motor controller, which may provide some of the foregoing functionality.

In the example of FIG. 3, the VSD unit 370 is shown along with a plot of a sine wave (e.g., achieved via a sine wave filter that includes a capacitor and a reactor), responsiveness to vibration, responsiveness to temperature and as being managed to reduce mean time between failures (MTBFs). The VSD unit 370 may be rated with an ESP to provide for about 40,000 hours (5 years) of operation at a temperature of about 50 C with about a 100% load. The VSD unit 370 may include surge and lightening protection (e.g., one protection circuit per phase). With respect to operational cost, as an example, for a 373 kW load, an increase in efficiency of about 0.5% may translate into about $1,000 per year in power savings (e.g., depending on cost of power). As to leg-ground monitoring or water intrusion monitoring, such types of monitoring can indicate whether corrosion is or has occurred. Further monitoring of power quality from a supply, to a motor, at a motor, may occur by one or more circuits or features of a controller.

Overall system efficiency can affect power supply from the utility or generator. As described herein, monitoring of ITHD, VTHD, PF and overall efficiency may occur (e.g., surface measurements). Such surface measurements may be analyzed in separately or optionally in conjunction with a pump curve. VSD unit related surface readings (e.g., at an input to a VSD unit) can optionally be input to an economics model. For example, the higher the PF and therefore efficiency (e.g., by running an ESP at a higher frequency and at close to about a 100% load), the less harmonics current (lower ITHD) sensed by the power supply. In such an example, well operations can experience less loses and thereby lower energy costs for the same load.

While the example of FIG. 3 shows an ESP with centrifugal pump stages, another type of ESP may be controlled. For example, an ESP may include a hydraulic diaphragm electric submersible pump (HDESP), which is a positive-displacement, double-acting diaphragm pump with a downhole motor. HDESPs find use in low-liquid-rate coalbed methane and other oil and gas shallow wells that require artificial lift to remove water from the wellbore. A HDESP can be set above or below the perforations and run in wells that are, for example, less than about 2,500 ft deep and that produce less than about 200 barrels per day. HDESPs may handle a wide variety of fluids and, for example, up to about 2% sand, coal, fines and $H_2S/CO_2$.

Figure 4:
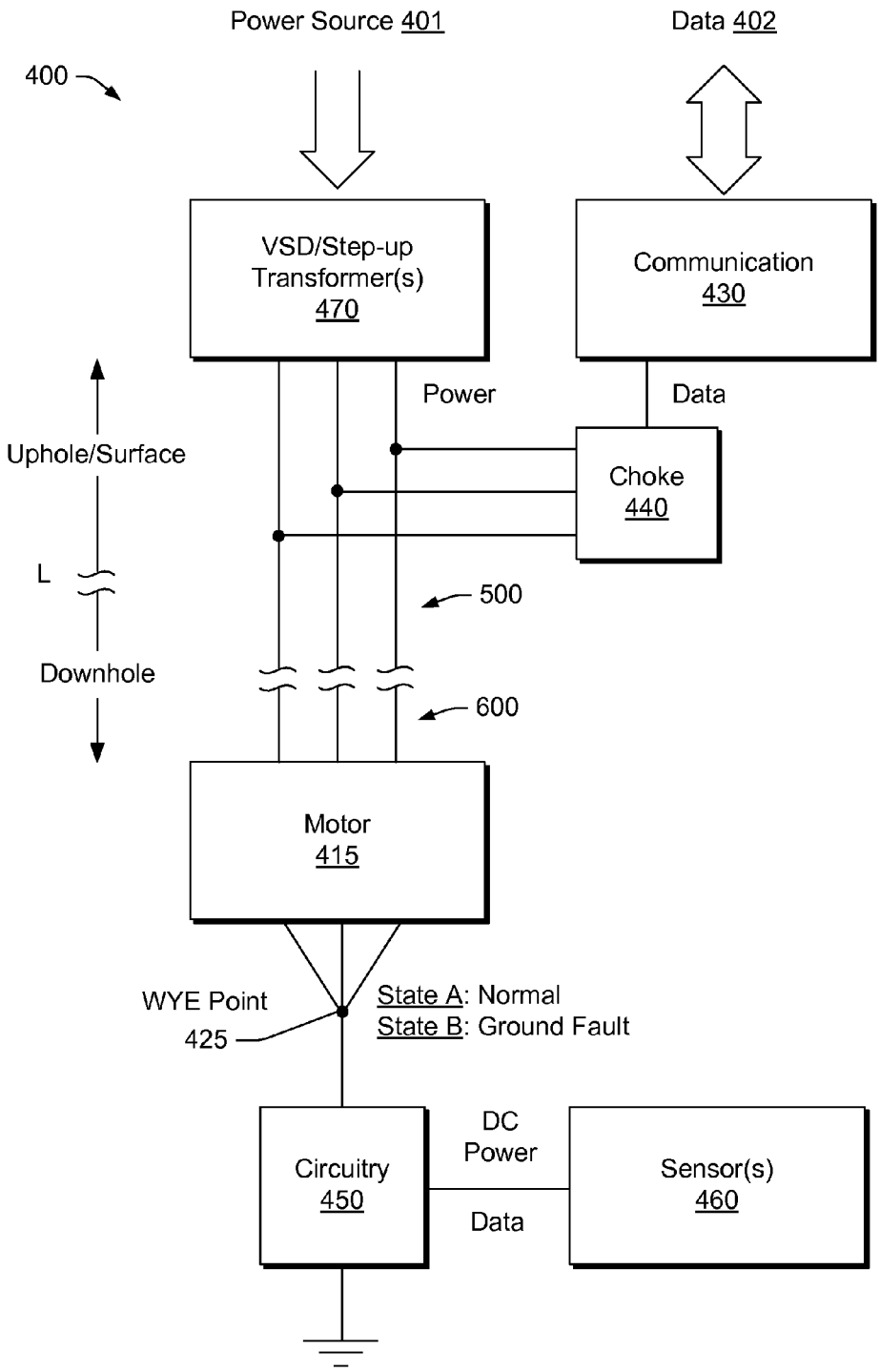
FIG. 4 illustrates an example of a system that a power cable and motor lead extensions.

FIG. 4 shows a block diagram of an example of a system 400 that includes a power cable 500 and MLEs 600. As shown, the system 400 includes a power source 401 as well as data 402. The power source 401 provides power to a VSD/step-up transformer block 470 while the data 402 may be provided to a communication block 430. The data 402 may include instructions, for example, to instruct circuitry of the circuitry block 450, one or more sensors of the sensor block 460, etc. The data 402 may be or include data communicated, for example, from the circuitry block 450, the sensor block 460, etc. In the example of FIG. 4, a choke block 440 can provide for transmission of data signals via the power cable 500 and the MLEs 600.

As shown, the MLEs 600 connect to a motor block 415, which may be a motor (or motors) of an ESP and be controllable via the VSD/step-up transformer block 470. In the example of FIG. 4, the conductors of the MLEs 600 electrically connect at a WYE point 425. The circuitry block 450 may derive power via the WYE point 425 and may optionally transmit, receive or transmit and receive data via the WYE point 425. As shown, the circuitry block 450 may be grounded.

The system 400 can operate in a normal state (State A) and in a ground fault state (State B). One or more ground faults may occur for any of a variety of reasons. For example, wear of the power cable 500 may cause a ground fault for one or more of its conductors. As another example, wear of one of the MLEs may cause a ground fault for its conductor.

The system 400 may include provisions to continue operation of a motor of the motor block 415 when a ground fault occurs. However, when a ground fault does occur, power at the WYE point 425 may be altered. For example, where DC power is provided at the WYE point 425 (e.g., injected via the choke block 440), when a ground fault occurs, current at the WYE point 425 may be unbalanced and alternating. The circuitry block 450 may or may not be capable of deriving power from an unbalanced WYE point and, further, may or may not be capable of data transmission via an unbalanced WYE point.

The foregoing examples, referring to "normal" and "ground fault" states, demonstrate how ground faults can give rise to various issues. Power cables and MLEs that can resist damaging forces, whether mechanical, electrical or chemical, can help ensure proper operation of a motor, circuitry, sensors, etc. Noting that a faulty power cable (or MLE) can potentially damage a motor, circuitry, sensors, etc. Further, as mentioned, an ESP may be located in several kilometers into a wellbore. Accordingly, the time and cost to replace a faulty ESP, power cable, MLE, etc., can be substantial.

Figure 5:
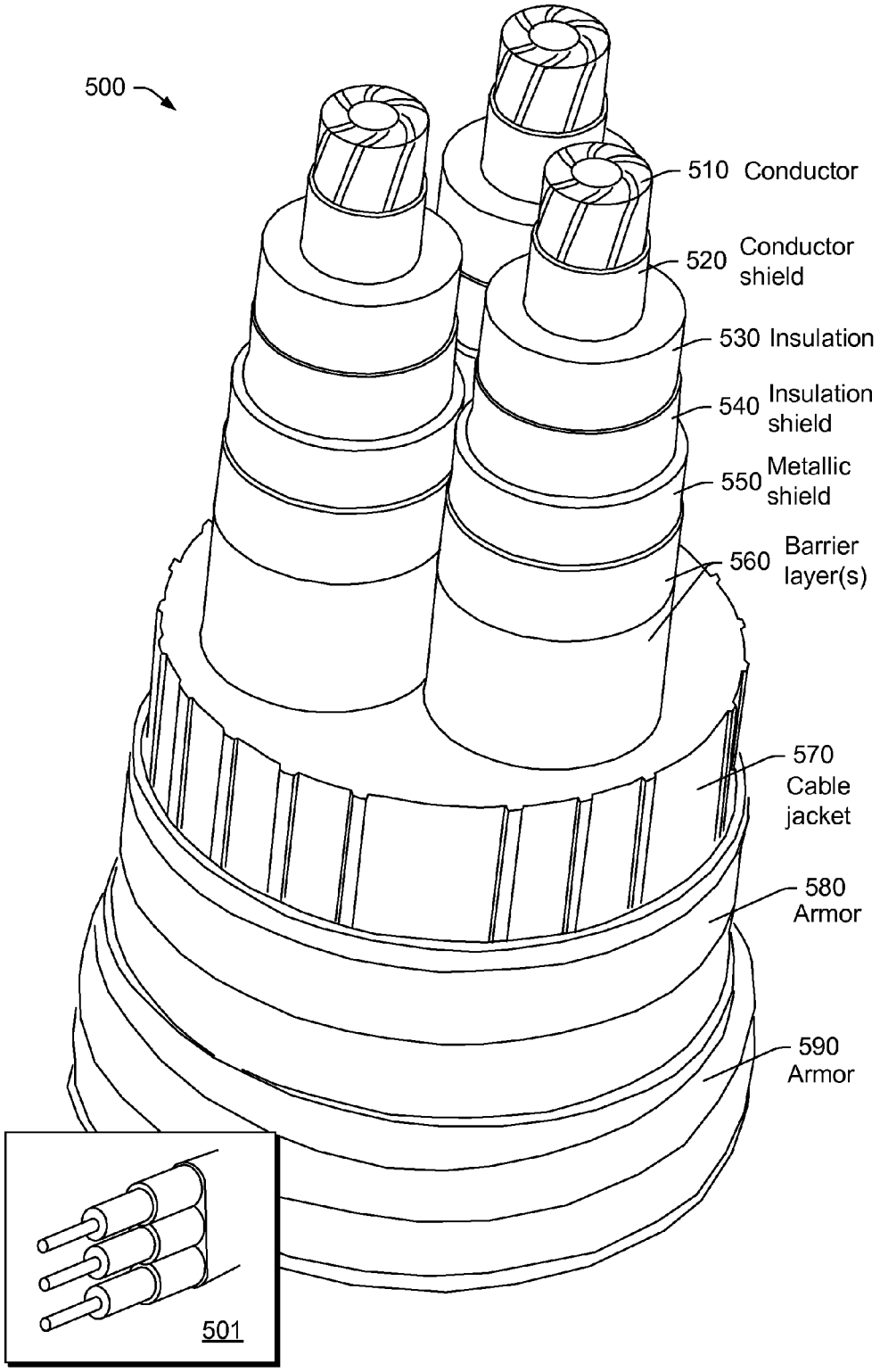
FIG. 5 illustrates an example of a power cable.

FIG. 5 shows an example of the power cable 500, suitable for use in the system 400 of FIG. 4 or optionally one or more other systems (e.g., SAGD, etc.). In the example of FIG. 5, the power cable 500 includes three conductor assemblies where each assembly includes a conductor 510, a conductor shield 520, insulation 530, an insulation shield 540, a metallic shield 550, and one or more barrier layers 560. The three conductor assemblies are seated in a cable jacket 570, which is surrounded by a first layer of armor 580 and a second layer of armor 590.

As to the conductor 510, it may be solid or compacted stranded high purity copper and coated with a metal (e.g., tin, lead, nickel, silver or other metal or alloy). As to the conductor shield 520, it may be a semiconductive material with a resistivity less than about 5000 ohm-m and be adhered to the conductor 510 to reduce or eliminate voids therebetween. As an example, the conductor shield 520 may be provided as an extruded polymer that penetrates into spaces between strands of the stranded conductor 510. As to extrusion of the conductor shield 520, it may optionally be co-extruded or tandem extruded with the insulation 530 (e.g., which may be EPDM). As an option, nanoscale fillers may be included for low resistivity and suitable mechanical properties (e.g., for high temperature thermoplastics).

As to the Insulation 530, it may be bonded to the conductor shield 520. As an example, the insulation 530 may include PEEK or EPDM. Where suitable, PEEK may be selected to provide for improved thermal cycling.

As to the insulation shield 540, it may be a semiconductive material having a resistivity less than about 5000 ohm-m. The insulation shield 540 may be adhered to the insulation 530, but, for example, removable for splicing, without leaving any substantial amounts of residue. As an example, the insulation shield 540 may be extruded polymer, for example, co-extruded with the insulation 530.

As to the metallic shield 550, it may be or include lead, as lead tends to be resistant to downhole fluids and gases. One or more lead layers may be provided, for example, to create an impermeable gas barrier.

As to the barrier 560, it may include PTFE fluoropolymer, for example, as tape that may be helically taped.

As to the cable jacket 570, it may be round or as shown in an alternative example, rectangular (e.g., "flat"). As to material of construction, a cable jacket may include one or more layers of EPDM, nitrile, HNBR, fluoropolymer, chloroprene, or other material (e.g., to provide for resistance to a downhole and/or other environment). As an example, each conductor assembly phase may include solid metallic tubing, such that splitting out the phases is more easily accomplished (e.g., to terminate at a connector, to provide improved cooling, etc.).

As to the cable armor 580 and 590, metal or metal alloy may be employed, optionally in multiple layers for improved damage resistance.

Figure 6:
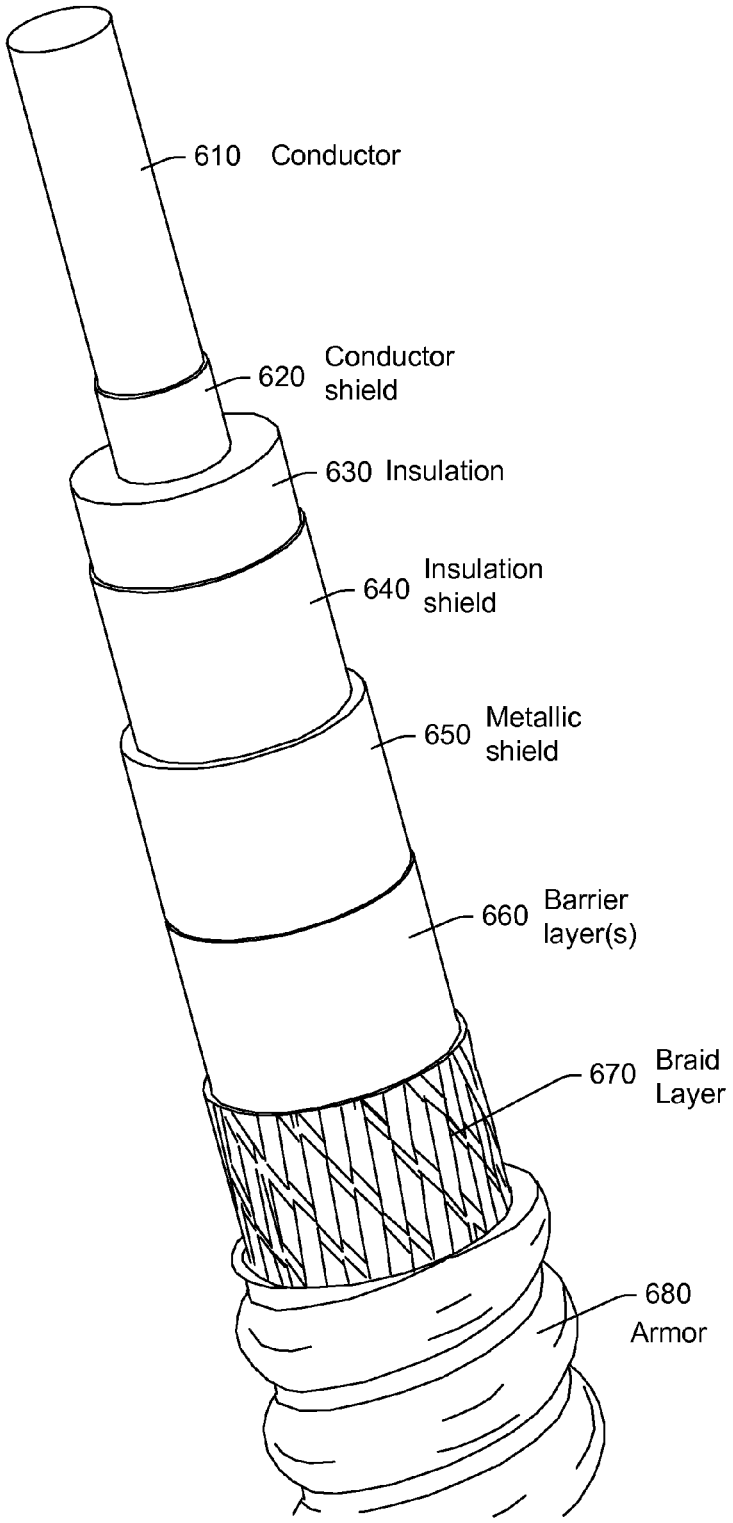
FIG. 6 illustrates an example of a motor lead extension.

FIG. 6 shows an example of one of the MLEs 600 suitable for use in the system 400 of FIG. 4 or optionally one or more other systems (e.g., SAGD, etc.). In the example of FIG. 6, the MLE 600 (or "lead extension") a conductor 610, a conductor shield 620, insulation 630, an insulation shield 640, a metallic shield 650, one or more barrier layers 660, a braid layer 670 and armor 680. While the example of FIG. 6 mentions MLE or "lead extension", it may be implemented as a single conductor assembly cable for any of a variety of downhole uses.

A power cable for artificial lift equipment can include one or more conductor assemblies, each including a copper conductor (e.g., solid, stranded, compacted stranded, etc.), a conductor shield with resistivity less than about 5000 ohm-m surrounding the conductor, insulation, an insulation shield having a resistivity less than 5000 ohm-m surrounding the insulation, a metallic shield surrounding the insulation shield, and a polymer barrier surrounding the metallic shield. Such a cable may include a jacket molded about the one or more conductor assemblies and optionally armor surrounding the jacket.

A power cable for downhole equipment can include a copper conductor (e.g., optionally solid); a conductor shield with resistivity less than about 5000 ohm-m surrounding the conductor; insulation (e.g., optionally EPDM or PEEK); an insulation shield having a resistivity less than about 5000 ohm-m surrounding the insulation; a metallic shield surrounding the insulation shield; a polymer barrier surrounding the metallic shield; a braided layer surrounding the metallic shield; and armor surrounding the braided layer.

As to a braid of a braided layer, various types of materials may be used such as, for example, polyethylene terephthalate (PET) (e.g., applied as a protective braid, tape, fabric wrap, etc.). PET may be considered as a low cost and high strength material. As an example, a braid layer can help provide protection to a soft lead jacket during an armor wrapping process. In such an example, once downhole, the function of the braid may be minimal. As to other examples, nylon or glass fiber tapes and braids may be implemented. Yet other examples can include fabrics, rubberized tapes, adhesive tapes, and thin extruded films.

As an example, a conductor (e.g., solid or stranded) may be surrounded by a semiconductive material layer that acts as a conductor shield where, for example, the layer has a thickness greater than approximately 0.005 inch. As an example, a cable can include a conductor with a conductor shield that has a radial thickness of approximately 0.010 inch. As an example, a cable can include a conductor with a conductor shield that has a radial thickness in a range from greater than approximately 0.005 inch to approximately 0.015 inch.

As an example, a conductor may have a conductor size in a range from approximately #8 AWG (e.g., OD approx. 0.128 inch or area of approx. 8.36 $mm^2$) to approximately #2/0 "00" AWG (e.g., OD approx. 0.365 inch or area of approx. 33.6 $mm^2$). As examples, a conductor configuration may be solid or stranded (e.g., including compact stranded). As an example, a conductor may be smaller than #8 AWG or larger than #2/0 "00" AWG (e.g., #3/0 "000" AWG, OD approx. 0.41 inch or area of approx. 85 $mm^2$).

As an example, one or more layers of a cable may be made of a material that is semiconductive (e.g., a semiconductor). Such a layer (e.g., or layers) may include a polymer or polymer blend with one or more conductive fillers (e.g., carbon black, graphene, carbon nanotubes, etc.) and optionally one or more additives (e.g., elastomer compound components, process aids, etc.). For example, a layer may include a polyolefin polymer (e.g., EPDM, etc.) and a graphite filler (e.g., expanded graphite, etc.). U.S. Patent Application Publication No. 2008/0149363, which is incorporated by reference herein, describes various types of semiconducting polymer compositions that include a polyolefine polymer and expanded graphite. As an example, a layer may include a PAEK polymer and a graphite filler (e.g., expanded graphite, etc.). For example, a layer may include PEEK as a thermoplastic and a graphite filler (e.g., expanded graphite, etc.). As an example, a layer may include a fluoropolymer and a graphite filler (e.g., expanded graphite, etc.).

As an example, a cable may include a conductor that has a size within a range of approximately 0.1285 inch to approximately 0.414 inch and a conductor shield layer that has a radial thickness within a range of approximately greater than 0.005 inch to approximately 0.015 inch.

As an example, a cable may include a conductor with a conductor shield (e.g., a semiconductor layer) and insulation (e.g., an insulation layer) where the conductor shield and the insulation are extruded. For example, the conductor shield may be extruded onto the conductor followed by extrusion of the insulation onto the conductor shield. Such a process may be performed, for example, using a co-extrusion, a sequential extrusion, etc.

As an example, an insulation shield (e.g., an insulator shield layer) may be extruded onto insulation after the insulation has been extruded onto a conductor shield (e.g., with an appropriate delay to allow for hardening of the insulation). In such a manner, the insulation shield may be more readily removed from the insulation, for example, when making cable connections (e.g., where stripping of the insulation shield is desired).

As an example, a cable may include a conductor shield, insulation and an insulation shield that have been extruded separately (e.g., by separate extruders with a delay to allow for hardening, etc.). As an example, a cable may include a conductor shield, insulation and insulation shield formed via co-extrusion, for example, using separate extrusion bores that feed to an appropriate cross-head, extrusion die or dies that deposit the layers in a substantially simultaneous manner (e.g., within about a minute or less).

As an example, an extrusion process may be controlled to allow for some amount of intermixing at an interface between two layers, for example, to provide for more complete bonding between the two layers. For example, as a conductor shield/insulation interface may be subject to high levels of electrical stress, an extrusion process may be performed to minimize defects, voids, contamination, etc., via intermixing at the interface (e.g., via co-extrusion of the two layers). As to an insulation shield, as mentioned, ease of removal may be beneficial when making connections. Further, electrical stresses tend to diminish for layers positioned outside of an insulation layer. As an example, a cable with a conductor, a conductor shield and insulation (e.g., in a non-molten state) may be fed to an extruder that covers the insulation with a molten semiconductive insulation shield. Such a process may reduce adhesion to a manageable point where the insulation shield can be stripped without damaging the insulation (e.g., for splicing cables).

As an example, a co-extrusion process to extrude multiple layers for a cable may include extrusion of one or more EPDM-based materials where, after their extrusion, they experience some amount of vulcanization that may cross-link the materials. For example, a conductor shield and insulation may be co-extruded in a manner that provides for some cross-linking to help eliminate voids between the conductor shield and the insulation. In such an example, the process may also help bond the conductor shield and hence the insulation to a conductor. Such a process may produce a cable suited to carry high voltage in terms of reliability. Such a process may also provide one or more other benefits (e.g., reduce process time, increase the product quality, etc.).

In comparison to tape, extrusion may provide for a reduction in the overall dimension of a cable (e.g., in some oil field applications, well clearance may be a concern). Extruded layers tend to be smoother than tape, which can help balance out an electrical field. For example, a tape layer or layers over a conductor can have laps and rough surfaces that can cause voltage stress points. Taping for adjacent layers via multiple steps may risk possible contamination between the layers. In contrast, a co-extrusion process may be configured to reduce such contamination. For example, co-extrusion may help to eliminate voids, contamination, or rough spots at a conductor shield/insulation interface, which could create stress points where discharge and cable degradation could occur. Thus, for improved reliability, smoothness and cleanness, a conductor shield may be extruded, optionally co-extruded with insulation thereon.

Figure 7:
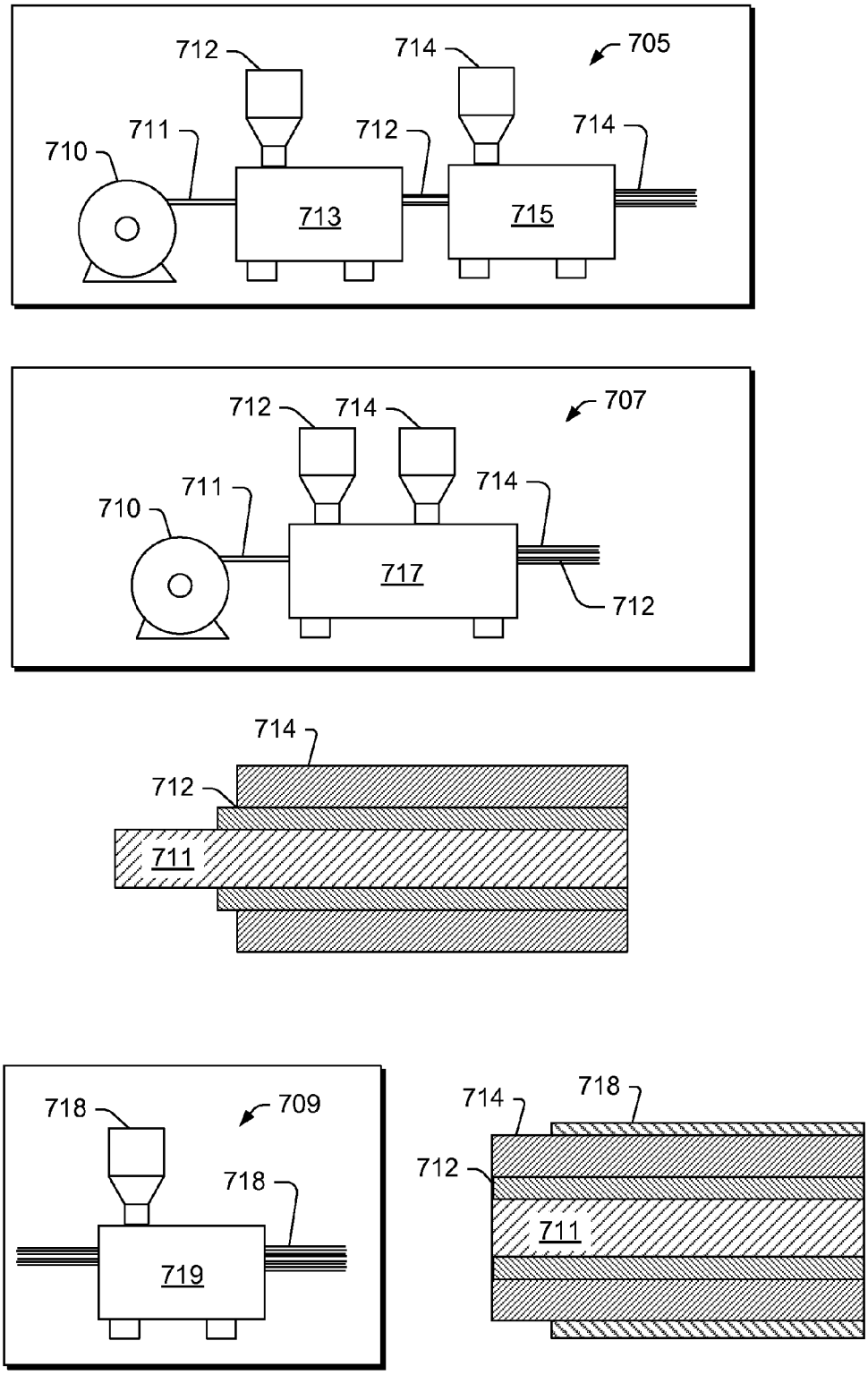
FIG. 7 illustrates examples of methods and examples of cables.

FIG. 7 shows example methods 705, 707 and 709 for extruding material as part of a cable manufacturing process. The method 705 includes providing a spool 710 with a conductor 711 carried thereon, providing material 712 for an extruder 713 and providing material 714 for an extruder 715. As shown, in the method 705, the conductor 711 is feed from the spool 710 to the extruder 713 which receives the material 712 (e.g., in a solid state), melts the material 712 and deposits it onto the conductor 711. Thereafter, the conductor 711 with the material 712 deposited thereon is feed to the extruder 715, which receives the material 714 (e.g., in a solid state), melts the material 714 and deposits it onto the material 712.

As to the method 707, an extruder 717 provides for co-extrusion of the materials 712 and 714 onto the conductor 711 as received from the spool 710. As mentioned, a co-extrusion process may include multiple extruder bores and a cross-head, die, dies, etc. to direct molten material onto a conveyed conductor (e.g., which may be bare or may have one or more layers deposited therein). In the methods 705 and 707, the material 712 may be a semiconductor to form a conductor shield and the material 714 may be an insulator to form insulation over the conductor shield. As an example, the materials 712 and 714 may be selected to allow for some amount of cross-linking at their interfaces upon deposition (e.g., in part facilitated by heat energy imparted via extrusion).

FIG. 7 shows a cross-section of an example of a cable as produced by the method 705 or the method 707 as including a conductor 711, a conductor shield 712 and insulation 714.

As an example, the cable produced by the method 705 or the method 707 may be input to the method 709 for deposition of another layer of material thereon. For example, material 718 may be provided (e.g., in a solid state) to an extruder 719 that receives the cable produced by the method 705 or the method 707 where the extruder 719 melts the material 718 and deposits it onto the layer formed by the material 714. As noted, a delay may exist between the method 705 or the method 707 and the method 709, for example, to allow for some amount of hardening of at least the layer formed by the material 714 such that stripping of the material 718 may be more readily achieved for purposes of splicing, etc. For example, where the material 718 forms an insulation shield over the material 714, which may be insulation, splicing may involve removal of the insulation shield while maintaining the integrity of the underlying insulation as well as the integrity of an underlying adjacent layer (e.g., a conductor shield). Further, in such an example, cross-linking between a conductor shield and insulation, as well as extrusion of the conductor shield onto a conductor, may provide sufficient interfacial bonding when subject to removal of an insulation shield from the insulation to maintain integrity of the conductor to conductor shield interface and the conductor shield to insulation interface.

In FIG. 7, as an example, the materials 712 and 718 may be semiconductive materials. As an example, the materials 712 and 718 may be the semiconductive same material (e.g., a polymer that includes one or more conductive fillers to form a semiconductive composite material).

As an example, a metallic shield over an insulation shield may be optional for a cable. For example, a cable may include a conductor, a conductor shield, insulation, an insulation shield and one or more barrier layers, at least one of which is directly in contact with the insulation shield. As an example, a cable may include semiconductive conductor and insulation shields but not include a grounded metallic shield over the semiconductive insulation shield.

Figure 8:
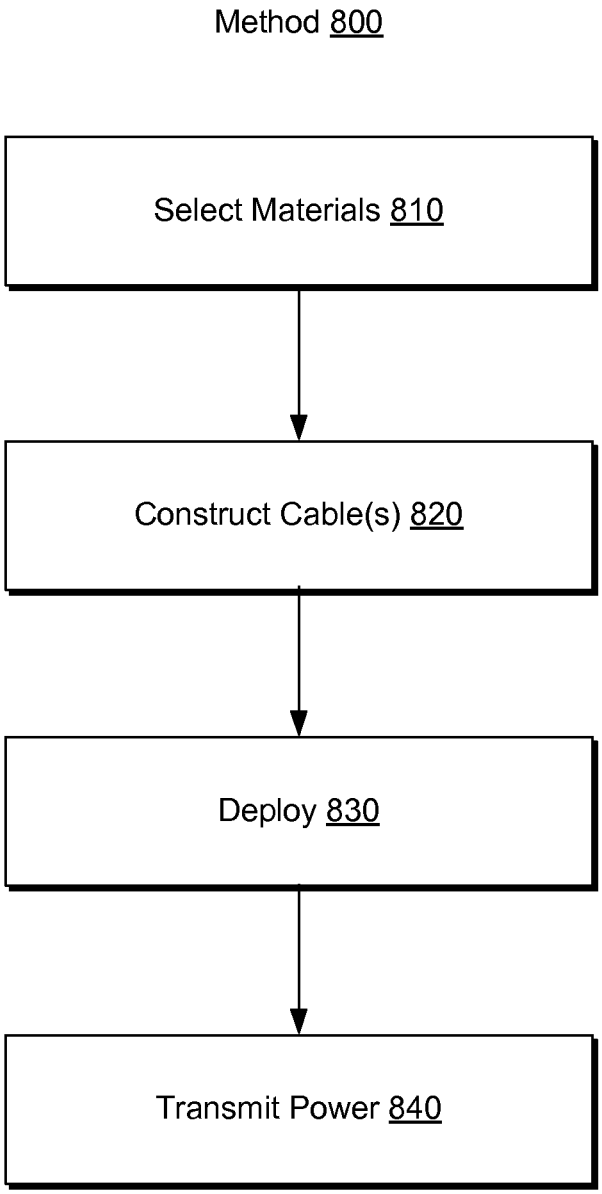
FIG. 8 illustrates an example of a method.

FIG. 8 shows a block diagram of a method 800. The method 800 includes a selection block 810 for selection of materials. In the method 800, a construction block 820 provides for constructing a cable using the selected materials. For example, such a block may include one or more extrusion or other processes. In the method 800, a deployment block 830 provides for deploying a constructed cable, for example, with respect to artificial lift equipment and a transmission block 840 provides for transmitting power to the equipment. As noted, a cable may also provide for data transmission.

As an example, one or more methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 9:
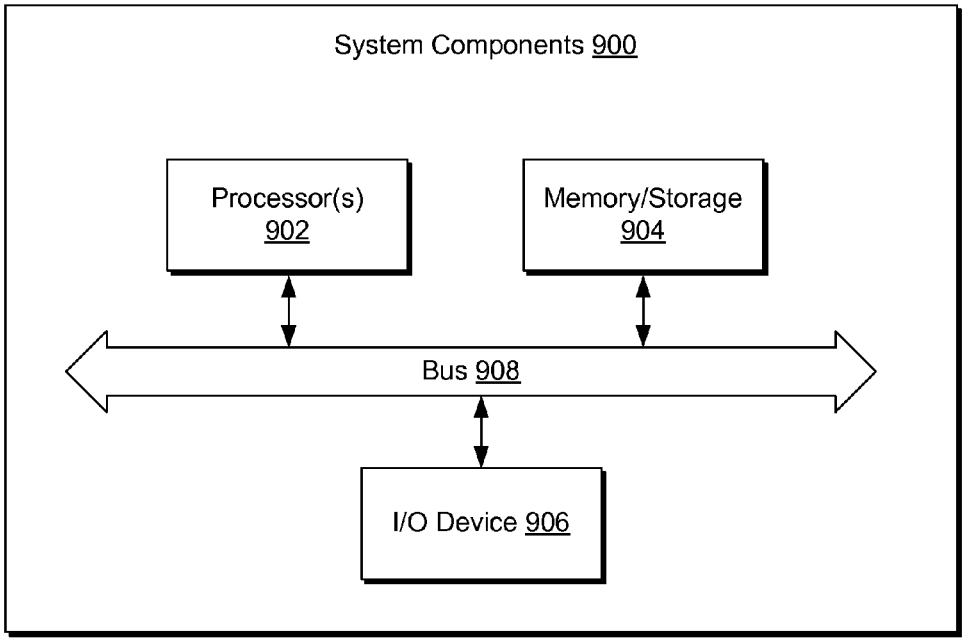
FIG. 9 illustrates example components of a system and a networked system.
Figure 9:
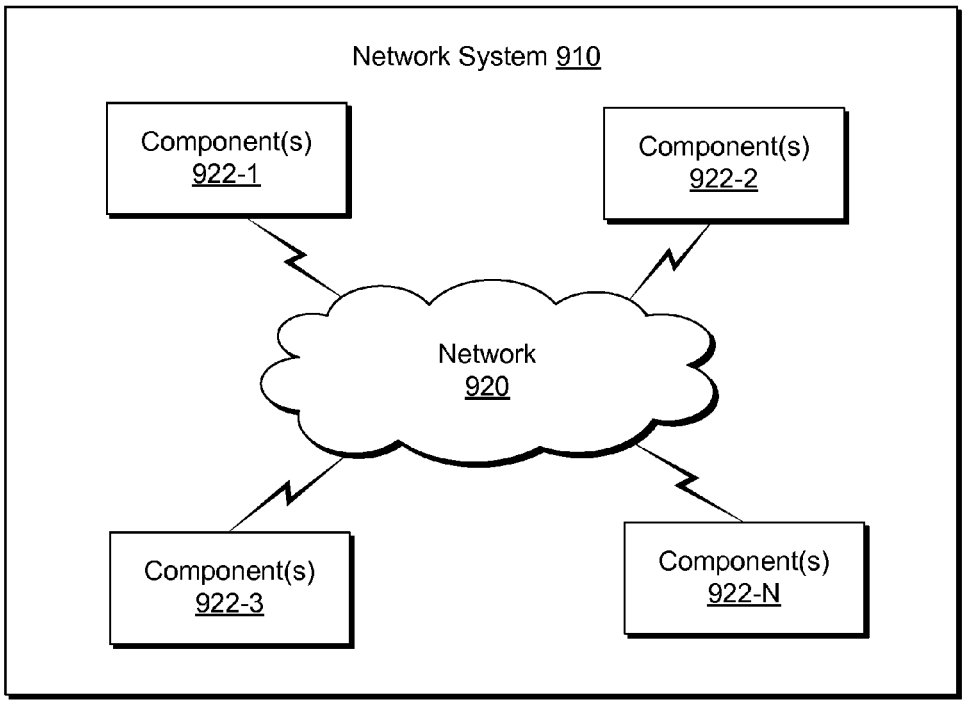

FIG. 9 shows components of a computing system 900 and a networked system 910. The system 900 includes one or more processors 902, memory and/or storage components 904, one or more input and/or output devices 906 and a bus 908. According to an embodiment, instructions may be stored in one or more computer-readable media (e.g., memory/storage components 904). Such instructions may be read by one or more processors (e.g., the processor(s) 902) via a communication bus (e.g., the bus 908), which may be wired or wireless. The one or more processors may execute such instructions to implement (wholly or in part) one or more attributes (e.g., as part of a method). A user may view output from and interact with a process via an I/O device (e.g., the device 906). According to an embodiment, a computer-readable medium may be a storage component such as a physical memory storage device, for example, a chip, a chip on a package, a memory card, etc.

According to an embodiment, components may be distributed, such as in the network system 910. The network system 910 includes components 922-1, 922-2, 922-3, . . . 922-N. For example, the components 922-1 may include the processor(s) 902 while the component(s) 922-3 may include memory accessible by the processor(s) 902. Further, the component(s) 902-2 may include an I/O device for display and optionally interaction with a method. The network may be or include the Internet, an intranet, a cellular network, a satellite network, etc.

CONCLUSION

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

The invention claimed is:

1. A power cable for artificial lift equipment, the power cable comprising:

one or more conductor assemblies, wherein each conductor assembly comprises a copper conductor, wherein the copper conductor comprises a compacted stranded copper conductor;

a conductor shield with resistivity less than about 5000 ohm-m surrounding the conductor, wherein the conductor shield comprises an extruded conductor shield that penetrates spaces in the compacted stranded copper conductor;

insulation; and an insulation shield having a resistivity less than about 5000 ohm-m surrounding the insulation, the insulation shield being formed of the same material as the conductor shield.

2. The power cable of claim 1 wherein each of the one or more conductor assemblies comprises EPDM.

3. The power cable of claim 1 wherein each of the one or more conductor assemblies comprises PEEK.

4. The power cable of claim 1 wherein each of the one or more conductor assemblies comprises lead (Pb).

5. The power cable of claim 1 wherein each of the one or more conductor assemblies comprises PTFE.

6. The power cable of claim 1 additionally comprising: a jacket disposed about the one or more conductor assemblies and armor surrounding the jacket; and wherein at least one conductor assembly additionally comprises: a metallic shield surrounding the insulation shield and a polymer barrier surrounding the metallic shield.

7. The power cable of claim 6 wherein the armor comprises at least one member selected from a group consisting of metals and metal alloys.

8. The power cable of claim 6 wherein the armor comprises multiple layers of armor.

9. The power cable of claim 6 wherein the armor comprises helically spun armor.

10. The power cable of claim 1 wherein the conductor shield and the insulation comprise co-extruded or tandem extruded materials.

11. The power cable of claim 1 wherein each of the one or more conductor assemblies comprises nanoscale fillers.

12. The power cable of claim 1 wherein the insulation comprises PEEK or EPDM.

13. The power cable of claim 6 wherein the metallic shield comprises lead (Pb).

14. The power cable of claim 1 wherein the polymer barrier comprises PTFE tape helically taped for surrounding the metallic shield.

15. The power cable of claim 6 wherein the armor comprises a circular cross-section or a polygonal cross-section.

16. A power cable for downhole equipment, the power cable comprising:

a copper conductor, wherein the copper conductor comprises a compacted stranded copper conductor;

a conductor shield with resistivity less than about 5000 ohm-m surrounding the conductor, wherein the conductor shield comprises an extruded conductor shield that penetrates spaces in the compacted stranded copper conductor;

insulation;

an insulation shield having a resistivity less than about 5000 ohm-m surrounding the insulation, the insulation shield being formed of the same material as the conductor shield;

a metallic shield surrounding the insulation shield;

a polymer barrier surrounding the metallic shield;

a braided layer surrounding the metallic shield; and armor surrounding the braided layer.

17. The power cable of claim 16 wherein the insulation comprises EPDM.

18. The power cable of claim 16 wherein the insulation comprises PEEK.

19. The power cable of claim 6 wherein the jacket comprises at least one member selected from a group consisting of EPDM, nitriles, HNBR, fluoropolymers, and chloroprene.

20. An artificial lift system comprising:

an electric submersible pump;

a power cable connected to the electric submersible pump, the power cable comprising:

one or more conductor assemblies, wherein each conductor assembly comprises:

a copper conductor, wherein the copper conductor comprises a compacted stranded copper conductor;

a conductor shield with resistivity less than about 5000 ohm-m surrounding the conductor, wherein the conductor shield comprises an extruded conductor shield that penetrates spaces in the compacted stranded copper conductor;

insulation extruded with the conductor shield while at least one of the conductor shield and the insulation comprises a nanoscale filler to adjust a material property; and an insulation shield having a resistivity less than about 5000 ohm-m surrounding the insulation, the insulation shield being formed of the same material as the conductor shield.

* * * * *